United States Patent [19]

Sakata et al.

[11] Patent Number: 4,745,435

[45] Date of Patent: May 17, 1988

[54] SHEET TRANSPORTING APPARATUS IN A PRINTING SYSTEM

[75] Inventors: Toshio Sakata; Tateomi Kono, both of Toyokawa, Japan

[73] Assignee: Minolta Camera Kabushiki Kaisha, Osaka, Japan

[21] Appl. No.: 886,686

[22] Filed: Jul. 18, 1986

[30] Foreign Application Priority Data

Jul. 29, 1985 [JP] Japan ..... 60-167969

[51] Int. Cl.[4] ..... G03G 15/00

[52] U.S. Cl. ..... 355/14 SH; 355/14 TR; 355/14 FU

[58] Field of Search ..... 355/14 SH, 14 R, 14 FU, 355/14 TR, 3 FU, 3 SH, 3 TR; 271/202, 270, 265; 219/216

[56] References Cited

U.S. PATENT DOCUMENTS

| | | | |
|---|---|---|---|
| 3,794,417 | 2/1974 | Machmer | 355/3 FU |
| 4,551,009 | 11/1985 | Shigemura et al. | 355/14 R |
| 4,557,589 | 12/1985 | Fukushi | 355/14 SH |
| 4,595,279 | 6/1986 | Kuru et al. | 355/14 FU |
| 4,621,921 | 11/1986 | Takahata et al. | 355/3 R |
| 4,634,262 | 1/1987 | Imaizumi et al. | 355/14 R |

FOREIGN PATENT DOCUMENTS

| | | | |
|---|---|---|---|
| 107276 | 8/1981 | Japan | 355/3 FU |

OTHER PUBLICATIONS

Xerox Disclosure Journal, vol. 10, No. 3, pp. 143-144, May/Jun. 1985.

*Primary Examiner*—R. L. Moses
*Assistant Examiner*—Ed Pipala
*Attorney, Agent, or Firm*—Burns, Doane, Swecker & Mathis

[57] ABSTRACT

A printing system for transferring powder images formed on a photo-sensitive drum to a printing sheet at a transferring station, into which the sheet is fed at a predetermined speed. The transferred powder images are fixed onto the sheet at a fixing station, while the transferred sheet is moved at a different speed. The transferred sheet is transported by a belt conveyor from the transferring station to the fixing station and is detected by a sensor located at a position between the transferring station and the belt conveyor, whose speed is controlled in accordance with data detected by the sensor.

10 Claims, 6 Drawing Sheets

SHEET TRANSPORTING APPARATUS IN A PRINTING SYSTEM

BACKGROUND OF THE INVENTION

1. Field of the Invention

This invention relates to a printing system, and more particularly to an apparatus for transporting sheets from a transferring station to a fixing station in a transfer type printing or copying machine.

2. Description of the Related Art

Generally speaking, in a transfer type printing system, an apparatus for transporting sheets between transferring and fixing stations is usually one of the types, transporting roller, or transporting belt, or a type of using both transporting belt and suction means, in which a sheet transporting speed is set to be constant in the transferring and fixing stations, as well as in the means for transporting the sheet therebetween so as not to give any damages to the unfixed powder images transferred on the printing sheets at the transferring station.

On the other hand, printing speed-up in a printing system has recently been required so that raising the sheet transporting speed in both the transferring and fixing stations will be necessary.

In the fixing station, however, there are usually provided fixing rollers comprising a pair of rollers such as a heat roller and a pressure roller to preserve desired heat efficiency and safety. Therefore, if transporting speed is too high at the fixing rollers, the fixing efficiency will be reduced. In order to solve the reduction of the fixing efficiency, a fixing temperature may be raised, or the pressure exerted between the fixing rollers may be raised. However, if the fixing temperature is too high, much more power will be consumed in the whole machine. In addition, there will be a limit in raising temperature for the heat endurance of the fixing rollers. On the other hand, if the roller pressure is raised, the printing sheets will be subjected to wrinkles or waves when they pass through the fixing rollers.

In order to solve the above-mentioned problems, U.S. Pat. No. 3,794,417 discloses a copy machine in which, when a sheet is passing through a transferring station, the speed of the transporting means is set to be the same as the sheet transporting speed in the transferring station, and on the other hand, after the rear edge of the sheet passes through the transferring station, the speed of the sheet transporting means is changed to be the same as the sheet transporting speed in the fixing station. Such a transporting speed control is effected by an eccentric pulley or cam rotating synchronizingly with a photo-sensitive drum, but not synchronizingly with the actual sheet movement. Therefore, if there was a delay in the time at which the rear edge of sheet should have been passed through the transferring station, the sheet would be subject to deflection or deformation between the transferring and fixing stations, which might occur damages on the powder images on the sheet. In addition, in order to proceed or use different sizes of sheets, several kinds of eccentric pullys or cams are necessary, which will make the machine more complicated.

SUMMARY OF THE INVENTION

Accordingly, an object of the present invention is to provide a sheet transporting apparatus in a printing system, in which printing sheets can be transported in high speed, which does not create problems such as, making wrinkles or waves on the sheets, sheet block, or giving damages on the powder images on the printing sheets.

According to the present invention, there is provided a transfer type printing system for transfer of powder images formed on a photo-sensitive member to a printing sheet at a transferring station, comprising: means for feeding the printing sheet to the transferring station at a predetermined speed; means for fixing the transferred powder images onto the sheets, while the transferred sheets are moved at a speed different from the above-mentioned speed; means for transporting the transferred sheet from the transferring station to the fixing means; means for detecting a position of the sheet position in a sheet transporting passage from the transferring station to the fixing means; and means for controlling the drive speed of the transporting means in accordance with data of the sheet position as detected by the detecting means.

DESCRIPTION OF THE PREFERRED EMBODIMENTS

Figure 1:
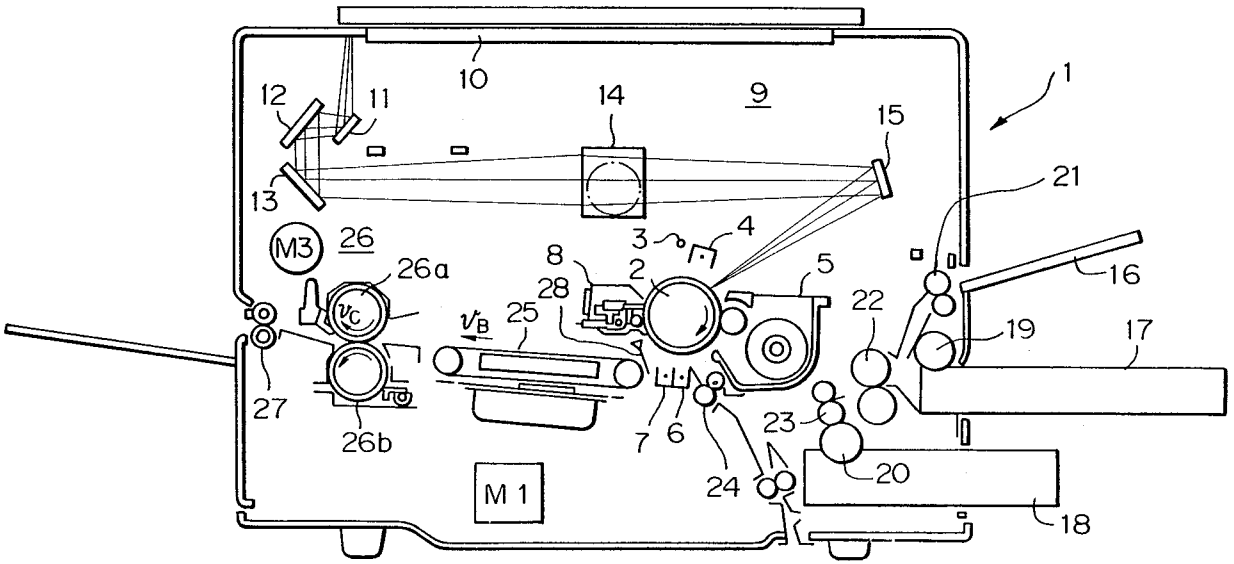
FIG. 1 is a side elevational view of a printing system including means for transporting sheets from a transferring station to a fixing station.

Referring now to FIG. 1, a printing system, such as a copying machine 1 is provided therein with a photosensitive drum 2 rotatable in the clockwise direction, and around the drum 2 there are an eraser lamp 3, an electrial charger 4, a developing means 5, a transfer charger 6, a printing sheet separation charger 7, and a blade type cleaning device 8. The photo-sensitive drum 2 is a drum provided over the outer suface thereof with a photosensitive layer, which is electrically charged when it passes through the above-mentioned eraser lamp 3 and electrical charger 4 and receives image exposure from an optical system 9.

The optical system 9 includes mirrors 11, 12, and 13 movable along the lower surface of a platen glass table 10, a lens 14, and an fixed mirror 15. The movable mirror 11 of this optical system 9 moves leftward at a speed v/n, wherein n is copy magnification, with respect to the peripheral speed v of the photo-sensitive drum 2, which speed is always constant irrespective to a one to one mode or variable magnification mode in the copying machine. Thus, the mirrors 12 and 13 are driven to move leftward at a speed v/2n by means of a DC motor $M_3$. If it is necessary to change the copy magnification, the lens 14 is to be moved along the optical axis and mirror 15 is to be moved and changed its angle.

On the other hand, the copying machine 1 is also provided at the right hand thereof with a manual sheet inlet table 16 and sheet supply cassettes 17 and 18 for loading printing sheets, so that the sheets are fed one by one by the rotation of first and second feed rollers 19 and 20 from the paper supply cassettes 17 and 18, respectively, or by manual operation from the manual paper inlet table 16. A sheet passage includes a pair of rollers 21 for manual insertion, pairs of rollers 22 and 23, a pair of timing rollers 24, transporting means 25, a pair of rollers including a heat roller 26a and a pressure roller 26b, a fixing means 26, a pair of discharge rollers 27. An actuator 28 for detecting copying papers passing therethrough is arranged in a transporting passage from the separation charger 7 to the transporting means 25. The actuator 28 constitutes a part of photo interrupter 28, as will be mentioned later.

Here, the photo-sensitive roller 2 rotates at a peripheral speed ($v_A$) and on the other hand the heat roller 26a and the pressure roller 26b in the fixing means 26 rotate in a speed ($v_C$), which speed ($v_C$) is smaller than the speed ($v_A$), so that a stable fixing can be obtained.

Figure 2:
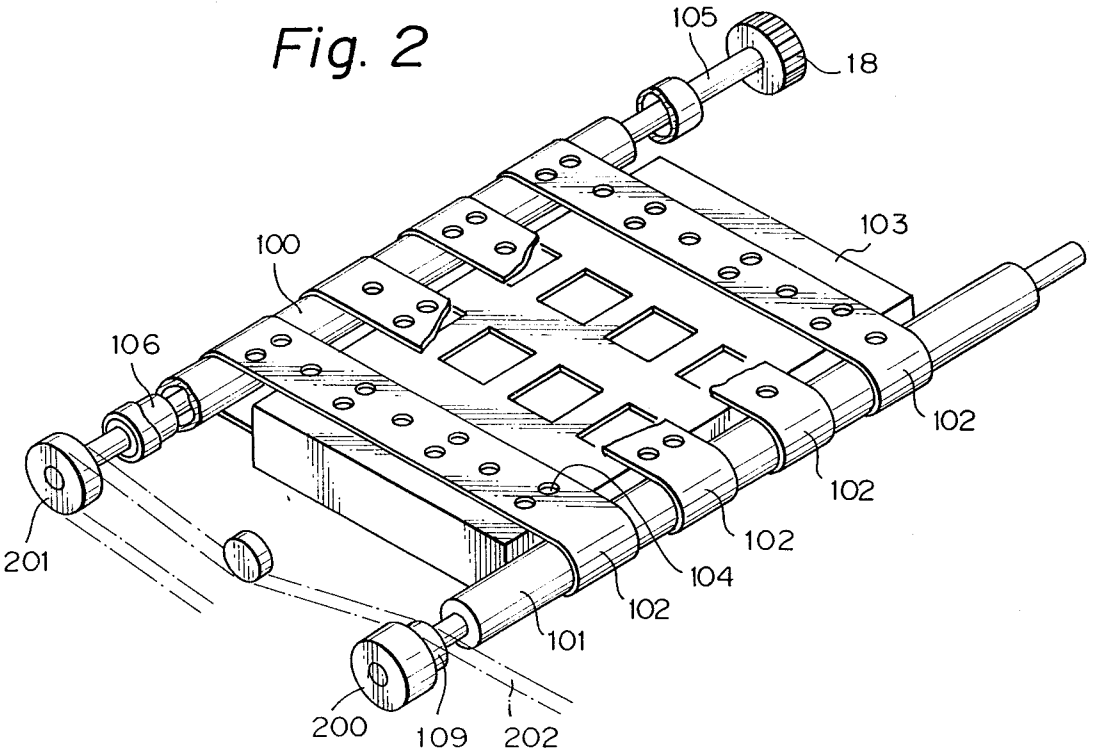
FIGS. 2 and 3 are partially exploded perspective and top plan views, respectively, illustrating a sheet transporting means.
Figure 3:
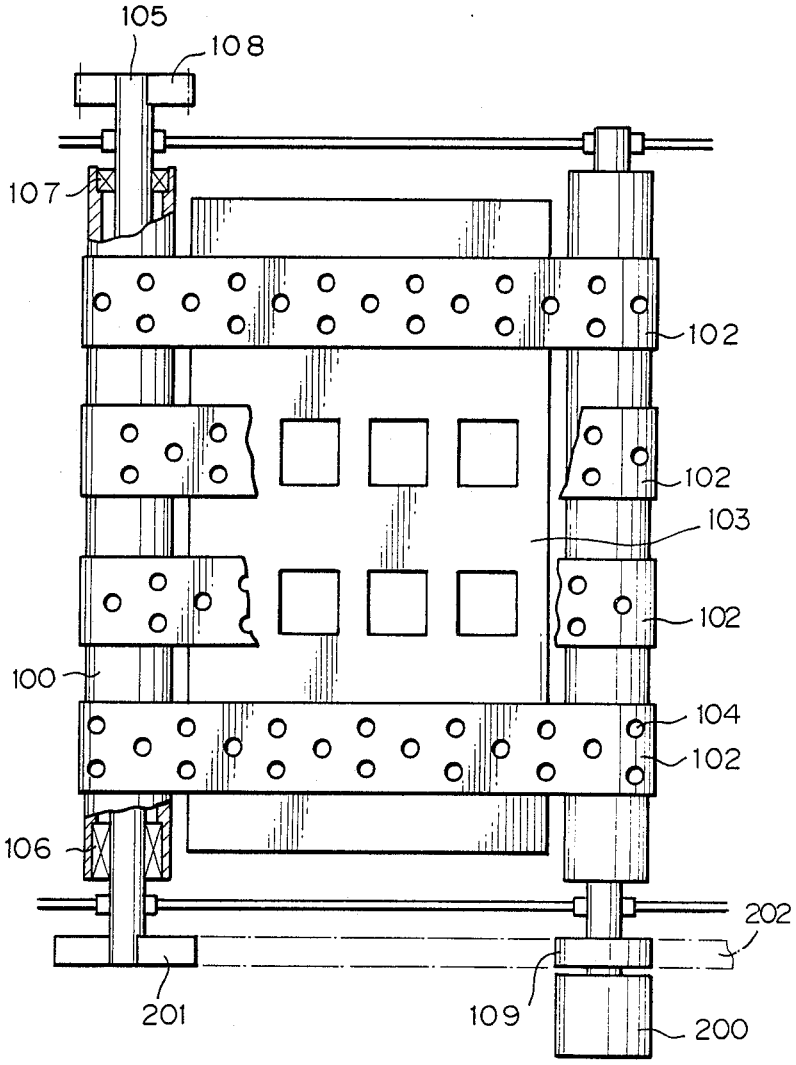

FIGS. 2 and 3 are a perspective and a top plan views, respectively, of the above-mentioned transporting means 25, in which belt driving rollers indicated at 100 and 101 carrying four endless belts 102 extending therebetween at a predetermined tension. Each belt 102 is provided with a plurality of suction slots 104, through which suction air is applied from a suction means 103 to the printing sheet P so as to be suctioned onto the surface of the belt 102. The belt driving roller 100 is supported on a driving shaft 105 by means of a one-way clutch 106 and bearings 107. The driving shaft 105 is rotated at a predetermined revolution speed $N_1$ by a main motor $M_1$ (FIG. 1) in this printing machine via a driving gear 108. When the driving shaft 105 is rotated, the one-way clutch 106 is locked to rotate the belt driving roller 100 and drive the belts 102 at a speed $v_1$. On the other hand, the belt driving roller 101 is associated with a solenoid clutch 200 provided with a driving pulley 109, which is driven by a driving pulley 201 mounted on the above-mentioned driving shaft 105 via a timing belt 202, so that, when the solenoid clutch 200 is turned ON, the belt driving roller 101 rotates at a predetermined revolution speed $N_2$ ($N_2 > N_1$) due to the difference of diameters of the driving pulleys 109 and 201. Thus, when the belts 102 are driven at a speed $v_2$ by the rotation of the belt driving roller 101, the one-way clutch 106 of the belt driving roller 100 is free from the driving shaft 105.

Consequently, when the solenoid clutch 200 is turned OFF, the one-way clutch 106 is locked, so that the belts 102 are moved at the speed $v_1$. When the solenoid clutch 200 is turned ON, the one-way clutch 106 is free from the driving shaft 105, so that the belts 102 are moved at the speed $v_2$ ($v_2 > v_1$). Here, there should be set such that $v_1 = v_C$ (sheet transporting speed at the fixing means 26), and $v_2 = v_A$ (sheet transporting speed at the transfer station 2).

Figure 4:
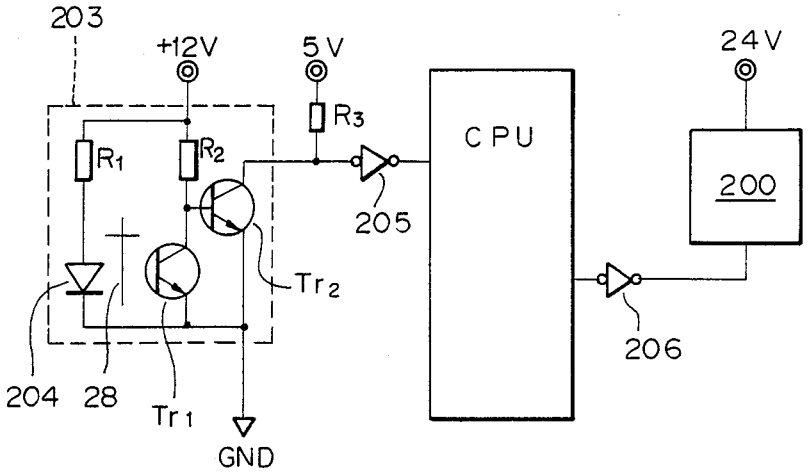
FIG. 4 is a diagram showing a control circuit for a solenoid clutch of the sheet transporting means.

A system for controlling the above-mentioned solenoid clutch 200 will now be described with reference to FIG. 4, in which a photo interrupter generally indicated at 203 includes a light emitting diode 204, a photo transistor $Tr_1$, a transistor $Tr_2$, and the above-mentioned light actuator 28. The photo transistor $Tr_1$ and the emitting diode 204 are connected via resistance $R_1$ and $R_2$, respectively, to a direct current (DC) battery (+12 volt). The transistor $Tr_2$ is connected at its base to a point between the photo transistor $Tr_1$ and the resistance $R_2$, at its collector to a direct current battery (+5 volt), and at its emitter to the ground. When the actuator 28 is in a condition corresponding no sheet detection, the actuator is positioned between the optical diode 204 and photo transistor $Tr_1$, so that a light beam from the light emitting diode 204 is interrupted and is not permitted to reach the photo transistor $Tr_1$. Therefore, the collector-emitter of the photo transistor $Tr_1$ are in disconnecting condition, and a voltage is applied to the base of the transistor $Tr_2$, which is therefore turned ON, so that a signal of "L" (low) level is input to an input port of a microcomputer (CPU) via a buffer 205. On the other hand, when the sheet is fed toward the transporting means 25 from the transferring station, the front edge of the sheet first comes into contact with the actuator 28, which is therefore turned, so that the light beam from the light emitting diode 204 is received by the phototransistor $Tr_1$, which is thus turned ON. When the phototransistor $Tr_1$ is turned ON, the voltage at the base of the phototransistor $Tr_2$ is reduced and the phototransistor $Tr_2$ is thus turned OFF, so that a signal of "H" (high) level is input to the input port of the microcomputer (CPU) via the buffer 205.

As mentioned above, when a signal of "H" or "L" level is input to the input port of the microcomputer (CPU), a control signal is output to the solenoid clutch 200 via a buffer 206 from an output port of the microcomputer (CPU), so that the solenoid clutch 200 is turned OFF when the signal is "L" level and turned ON when the signal is "H" level.

Figure 5:
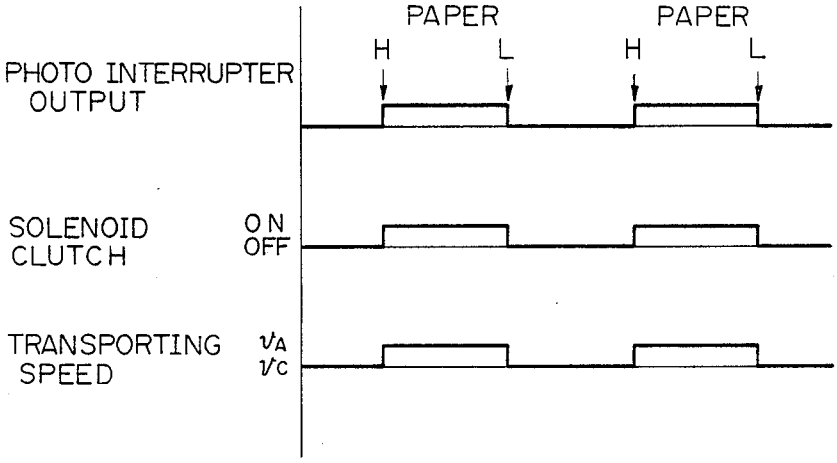
FIG. 5 is a timing chart for illustrating the operation of the sheet transporting means.
Figure 6:
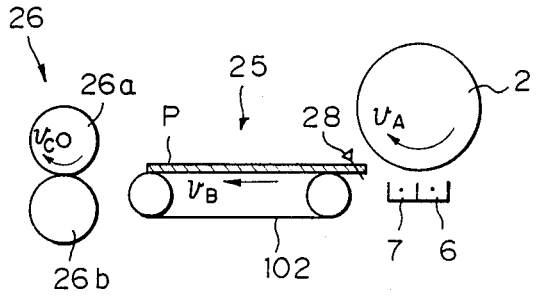
FIGS. 6 and 7 are schematic views for illustrating the sheet transportation from the transferring station to the fixing station.
Figure 7:
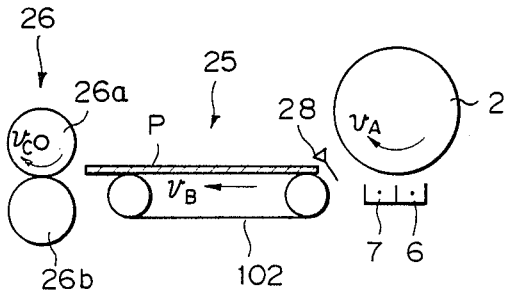
Figure 8:
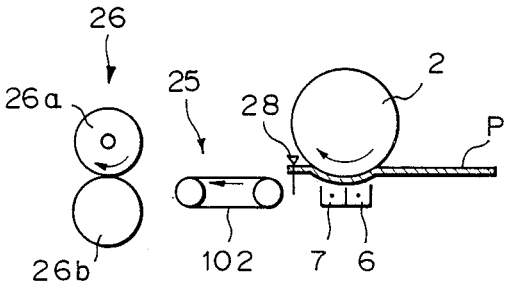
FIGS. 8, 9 and 10 are schematic views for illustrating a sheet transportation in case that a sheet is longer than the distance between the transferring and fixing stations; and, FIG. 11 is a schematic illustration of a sheet transportation in a prior art.
Figure 9:
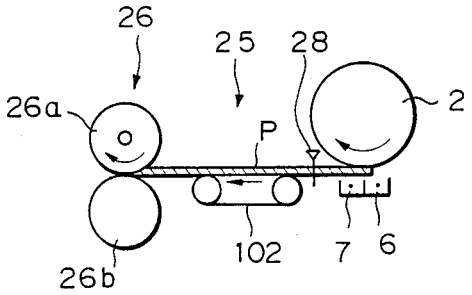
Figure 10:
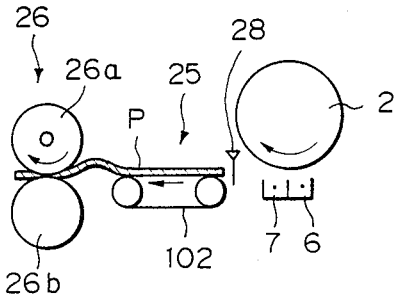
Figure 11:
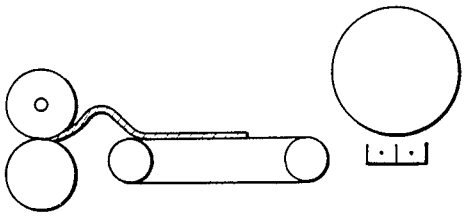
Fig. 11 (PRIOR ART)

The operation of this embodiment will now be described with reference to a timing diagram shown in FIG. 5. When a sheet P is transferred with powder image at the transferring station and fed to the transporting means 25, the front edge of the sheet P is detected by the actuator 28, so that a signal of "H" level for instructing a fact that a sheet is detected is input to the microcomputer (CPU), which outputs a signal for turning ON the solenoid clutch 200. When the solenoid clutch 200 is turned ON, the speed of the transporting means 25 is set to be the same speed $v_A$ as the transporting speed of sheet passing through the transfer charger 6 (see FIG. 6). Thus, the sheet P is transported at the speed $v_A$. Then, when the rear edge of the sheet P passes by the actuator 28, a signal of "L" level is input from the photo interrupter 203 to the microcomputer (CPU) and a signal is output from the microcomputer (CPU) for turning OFF the solenoid clutch 200. Thus, when the solenoid clutch 200 is turned OFF, the speed of the transporting means 25 is set to be the same speed $v_C$ as the sheet transporting speed at the fixing means 26 (see FIG. 7). While the paper sheet P is transported from the transporting means 25 to the fixing means 26, the sheet P will not form a loop between the fixing means 26 and the transporting means 25, since the speeds at the fixing means 26 and the transporting means 25 are the same.

Although the above embodiment illustrates a case, in which the sheet P is shorter than the distance from the transferring station to the fixing means 26, a control system as mentioned above with reference to this embodiment is also applicable to another case, in which the sheet P is longer than the distance from the transferring station to the fixing means 26. In this case, although the sheet P forms a loop in front of the fixing means 26, the loop forming time is only from when the front edge of sheet P reaches the fixing means 25 to a time when the rear edge thereof passes by the actuator 28, and after that the speed $v_B$ of the transporting means 25 becomes the same as the transporting speed $v_C$ of the fixing means 26, thereby preventing the loop from being developed. Therefore, the loop does not cause any troubles to the sheet, such as wrinkles or waves of sheet, sheet blocks, or any damages on powder images.

In the above-mentioned embodiment, although the sheet P is detected such that, whether the sheet has passed through the transferring station, by means of the actuator 28 arranged between the transporting means 25 and the transferring station, any other types of sensors can also be employed.

We claim:

1. A transfer type printing system for transferring powder images formed on a photo-sensitive member to a printing sheet at a transferring station, comprising:

means for feeding the printing sheet to the transferring station at a predetermined speed;

means for fixing the transferred powder images onto the sheet, while the transferred sheet is moved at a speed different from the above-mentioned predetermined speed;

means for transporting the transferred sheet from the transferring station to the fixing means;

means for detecting a position of the sheet in a sheet transporting passage from the transferring station to the fixing means; and, means for controlling the drive speed of the sheet transporting means in accordance with data detected by the detecting means.

2. A printing system as set forth in claim 1, wherein the transporting means comprises a plurality of transporting belts.

3. A printing system as set forth in claim 2, wherein the transporting belts are extended between two belt driving rollers, one of the rollers is connected to a drive source via a clutch means so as to drive the belts at the predetermined speed, and the other roller is also connected to the drive source via another clutch means so as to drive the belts at the other speed.

4. A printing system as set forth in claim 2, wherein the transporting means further comprises suction means for sucking the transcripted sheet onto the transporting belts.

5. A transfer type printing system for transferring powder images formed on a photo-sensitive member to a printing sheet at a transferring station, comprising:

means for feeding the printing sheet to the transferring station at a first speed;

means for fixing the transferred powder images onto the sheet, while the transferred sheet is moved at a second speed different from the first speed;

means for transporting the transferred sheet from the transferring station to the fixing means;

sheet detecting means arranged between the transferring station and the transporting means, said sheet detecting means being adapted to detect front and rear edges of the sheet; and, means for controlling the drive speed of the transporting means so as to be the same as the first speed in accordance with the detection of the front edge of the sheet, and the second speed in accordance with the detection of the rear edge of the sheet.

6. A printing system as set forth in claim 5, wherein the sheet detecting means comprises an actuator which physically detects the front and rear edges of the sheet and a photo interrupter activated by the actuator.

7. A transfer type printing system for transferring powder images formed on a photo-sensitive member to a printing sheet at a transferring station, comprising:

means for feeding the printing sheet to the transferring station at a first predetermined speed;

means for fixing the transferred powder images onto the sheets, while the transferred sheet is moved at a second speed which is lower than the first speed;

means for transporting the transferred sheet from the transferring station to the fixing means;

sheet detecting means arranged between the transferring station and the transporting means, said sheet detecting means being adapted to detect the presence of the sheet; and, means for controlling the drive speed of the transporting means so as to be the same as the first speed at least during the detecting means being detecting the presence of sheet, and the second speed during the detecting means is detecting no sheet.

8. A printing system as set forth in claim 7, wherein the transporting means comprises a plurality of transporting belts extending between two belt driving rollers, one of the rollers is connected to a drive shaft via a one-way clutch, the other roller is connected to the same drive shaft via a solenoid clutch and speed increasing means, the solenoid clutch is controlled by the detecting means, such that at least when the detecting means detects the presence of sheet, the solenoid clutch engages the other roller with the drive shaft so as to drive the belts at the first speed through the other roller, and when the detecting means detects no sheet, the solenoid clutch disengages the other roller from the drive shaft, so that the one roller drives the belts at the second speed via the one-way clutch.

9. A printing system as set forth in claim 8, wherein the one roller is hollow cylindrical and rotatably supported on the drive shaft by means of bearings and the one-way clutch, and the other roller is connected to the drive shaft via a timing belt and the solenoid clutch.

10. A printing system as set forth in claim 7, wherein the fixing means a pair of a heat roller and a pressure roller, between which the transcripted sheet passes, so that powder images on the sheet are fixed.

* * * * *